US007017449B1

(12) United States Patent
Ritchings

(10) Patent No.: US 7,017,449 B1
(45) Date of Patent: Mar. 28, 2006

(54) TOOL FOR INSTALLATION/REMOVAL OF SCREW-IN STEPS

(76) Inventor: Allen E. Ritchings, 6 Sumner Ave., Toms River, NJ (US) 08755

( * ) Notice: Subject to any disclaimer, the term of this patent is extended or adjusted under 35 U.S.C. 154(b) by 34 days.

(21) Appl. No.: 10/843,992

(22) Filed: May 13, 2004

(51) Int. Cl.
*B25B 23/16* (2006.01)

(52) U.S. Cl. ..... 81/52; 81/901; 81/177.2; 182/92

(58) Field of Classification Search ..... 81/52, 81/177.2, 176.15, 176.2, 176.1, 44, 184, 81/901; 294/92; 182/92
See application file for complete search history.

(56) References Cited

U.S. PATENT DOCUMENTS

| | | | | |
|---|---|---|---|---|
| 2,392,538 | A | 1/1946 | Knudsen | |
| 3,380,697 | A | 4/1968 | Melcher | |
| 4,413,706 | A | 11/1983 | Michael | |
| 4,669,575 | A | 6/1987 | Skyba | |
| 4,700,807 | A | 10/1987 | Kubiak | |
| 5,279,388 | A | 1/1994 | Laughlin et al. | |
| 5,624,007 | A * | 4/1997 | Mahaffy | 182/92 |
| 5,743,353 | A | 4/1998 | Browning et al. | |
| 5,806,625 | A * | 9/1998 | Katz | 182/92 |
| 5,899,124 | A * | 5/1999 | Cross, Jr. | 81/176.15 |
| 6,205,935 | B1 | 3/2001 | Lindaman | |

* cited by examiner

*Primary Examiner*—Debra S Meislin
(74) *Attorney, Agent, or Firm*—John D. Gugliotta

(57) ABSTRACT

A tool is provided to aid in the insertion and removal of tree steps used with blinds in trees while hunting. The invention takes the form of a "Z"-shaped crank made of flat steel stock. The middle portion of the crank has a hole that is placed over the step on the step portion. The upper portion of the crank, has two slots on either side, one of which is used for installing a tree step, while the other is used to remove the tree step. Finally, the lower portion of the crank forms a handle, which can be padded with a cushion or handle grip.

5 Claims, 4 Drawing Sheets

TOOL FOR INSTALLATION/REMOVAL OF SCREW-IN STEPS

BACKGROUND OF THE INVENTION

1. Field of the Invention

The present invention relates generally to hunting and camping equipment and, more particularly, to a portable tool for aiding in the installation or removal of temporary stairs for egress to a tree or elevated hunting blind.

2. Description of the Related Art

Over the years, modern advances in hunting equipment have enhanced the sport, providing hunters with increased success. Although many of these products are high-technology devices, some products are amazingly simple. An example of such a product is a set of tree steps, which aids the hunter in climbing a tree to gain access to a tree stand or blind. While such steps are simple in design, they require some effort to screw into the tree. Such an activity takes time, which reduces the amount of time for hunting. Additionally, if shortcuts are taken, and the step is not fully inserted, dangerous slips and falls can result. Finally, such problems are repeated when trying to remove the steps when hunting is completed. If the hunter simply decides to leave them behind, an additional cost is realized by having to replace them next time hunting is attempted. Additionally, such steps left behind can have a negative impact on the ecology and local wildlife.

A search of the prior art did not disclose any patents that read directly on the claims of the instant invention; however, the following references were considered related:

- U.S. Pat. No. 6,205,935, issued in the name of Lindaman, discloses a bolt-mounted shelf for use with hunters' tree stands;
- U.S. Pat. No. 5,743,353, issued in the name of Browning et al., discloses a tree step socket;
- U.S. Pat. No. 5,279,388, issued in the name of Laughlin et al., discloses a step adapted to be screwing into a tree;
- U.S. Pat. No. 4,700,807, issued in the name of Kubiak, discloses a tree step with means for driving an anchor screw into a tree;
- U.S. Pat. No. 4,669,575, issued in the name of Skyba, discloses a tree step;
- U.S. Pat. No. 4,413,706, issued in the name of Michael, discloses a tree step;
- U.S. Pat. No. 3,380,697, issued in the name of Melcher, discloses portable steps for climbing trees or poles; and
- U.S. Pat. No. 2,392,538, issued in the name of Knudson, discloses a pole climber and safety device.

Consequently, a need has been felt for providing a means by which tree steps can be easily inserted and removed thus eliminating the disadvantages as described above.

SUMMARY OF THE INVENTION

It is therefore an object of the present invention to provide a portable tool for aiding in the installation or removal of temporary stairs for egress to a tree or elevated hunting blind.

It is a feature of the present invention to provide an improved tool for aiding in the installation or removal of temporary stairs for egress to a tree or elevated hunting blind that can be adaptably and modularly used in the field to ascend any selected tree.

Briefly described according to one embodiment of the present invention, a tool is provided to aid in the insertion and removal of tree steps used with blinds in trees while hunting. The invention takes the form of a "Z"-shaped crank made of flat steel stock. The middle portion of the crank has a hole that is placed over the step on the step portion. The upper portion of the crank, has two slots on either side, one of which is used for installing a tree step, while the other is used to remove the tree step. Finally, the lower portion of the crank forms a handle, which can be padded with a cushion or handle grip.

Further, to use the invention, the user simply places a step in the invention and starts screwing it into the tree in a clockwise manner. To remove the step, the other slot it utilized and the invention is turned in a counterclockwise manner.

BRIEF DESCRIPTION OF THE DRAWINGS

The advantages and features of the present invention will become better understood with reference to the following more detailed description and claims taken in conjunction with the accompanying drawings. in which like elements are identified with like symbols, and in which:

DESCRIPTION OF THE PREFERRED EMBODIMENTS

Figures 1A, 1B:
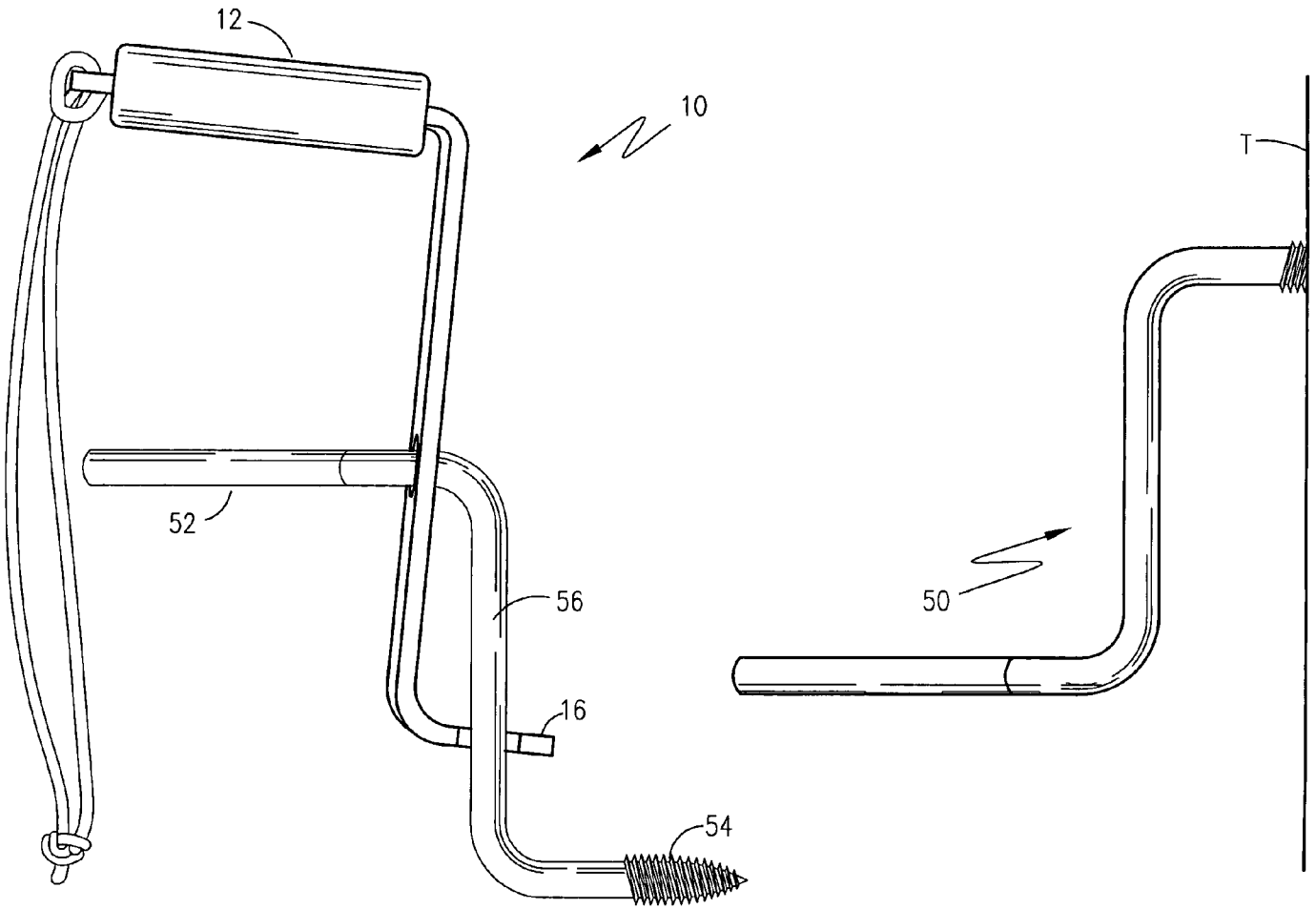
FIG. 1 is a front perspective view of the preferred embodiment of a hunter's tool for installation/removal of screw-in steps shown in use with such steps, as well as a side elevational view showing installation into a side of a tree.
Figure 2:
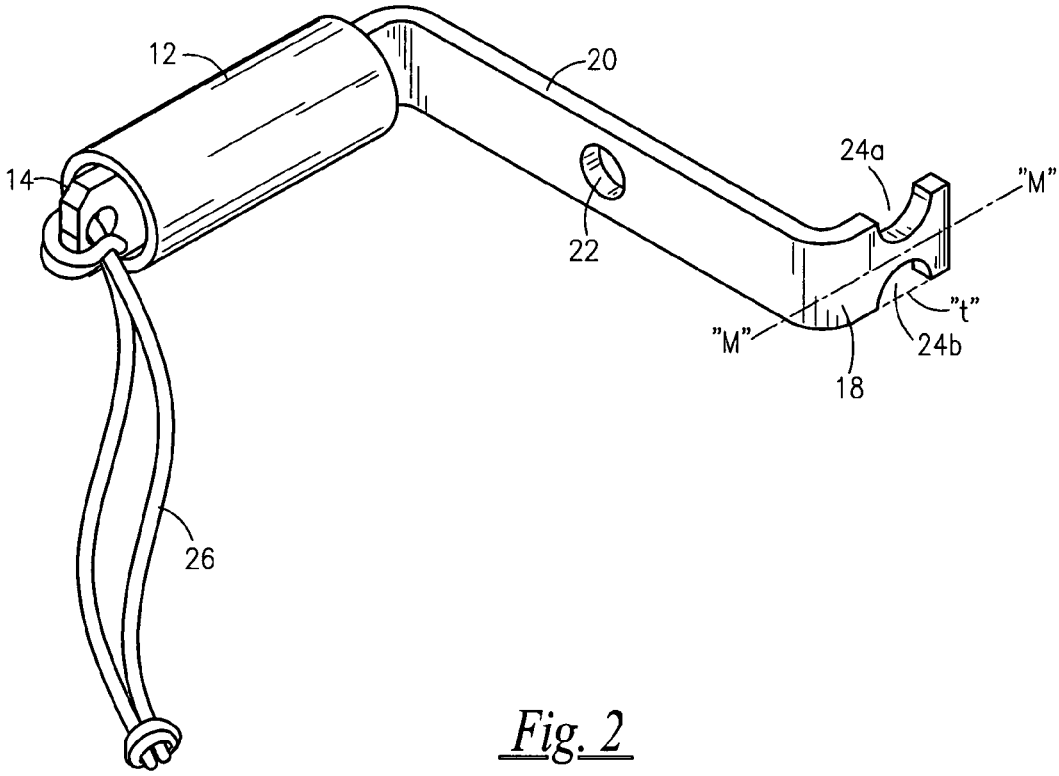
FIG. 2 is a side perspective view of the step component thereof.

The best mode for carrying out the invention is presented in terms of its preferred embodiment, herein depicted within the FIGS. 1–4.

1. Detailed Description of the Figures

Referring now to FIG. 1 through FIG. 4, a tool 10 is depicted in accordance with a preferred embodiment of the present invention. In one exemplary embodiment, the tool 10 facilitates the insertion or removal of steps 50. The steps 50 are used so that a hunter may ascend to a hunting blind in the tree "T", or descend from the hunting blind back to the ground surface. For reference, a step 50 has a "Z"-shaped body having a step portion 52, a threaded tail portion 54 and a linearly elongated intermediate member 56 disposed therebetween. The tool 10 has a "Z"-shape and comprises a handle 12 affixed at an end 14, a tongue 16 at an opposite end 18, and a linearly elongated arm 20 disposed intermediately to the ends 14 and 18. The tool 10 may also include a tether 26 for temporarily holding or storing the tool 10.

The handle 12 may have a pad or cushion to provide comfort to a user's hand. Furthermore, the handle 12 may have a contoured surface for properly ergonomic alignment of the hand and digits. The handle 12 may be fabricated from metal, plastic, rubber or other similarly suitable materials that are durable.

The arm 20 has an aperture 22 formed therein, the aperture 22 having a diameter slightly larger than the diameter of the step portion 52, thereby accommodating the step portion 52. The step portion 52 and aperture 22 are cooperatively coupled by insertion of the step portion 52 into the aperture 22 up to the junction of the step portion 52 and the member 56.

The tongue 16 has a pair of semi-circular indentations 24*a* and 24*b*, respectively, formed therein, the indentations 24*a* and 24*b* having a diameter across the imaginary terminus "t" slightly larger than the diameter of the member 56, thereby accommodating the member 56. Each indentation 24*a* and 24*b* is formed equidistant from an imaginary midline "M—M" that bisects the tongue 16 into two halves, the halves being a mirror image of the other.

In combination as a singular, unitary apparatus, the tool 10 receives the step portion 52 through the aperture 22. The member 56 is engaged by one of the indentations 24*a* or 24*b*, depending upon the action required—installation or removal. The tool 10 is rotated in either a clockwise or counterclockwise direction, the indentation 24*a* or 24*b* engaging and temporarily impinging the member 56, the tool 10 rotating about the step portion 52 received in the aperture 22. After installation or removal, the indentation 24*a* or 24*b* is disengaged from the member 56, and the step portion 52 removed from the aperture 22. Installation and removal may be repeated as often as necessary.

2. Operation of the Preferred Embodiment

To use the tool 10 in accordance with the preferred embodiment, a step 50 is selected for installation or removal, each operation described in sufficient detail herein.

Figure 3:
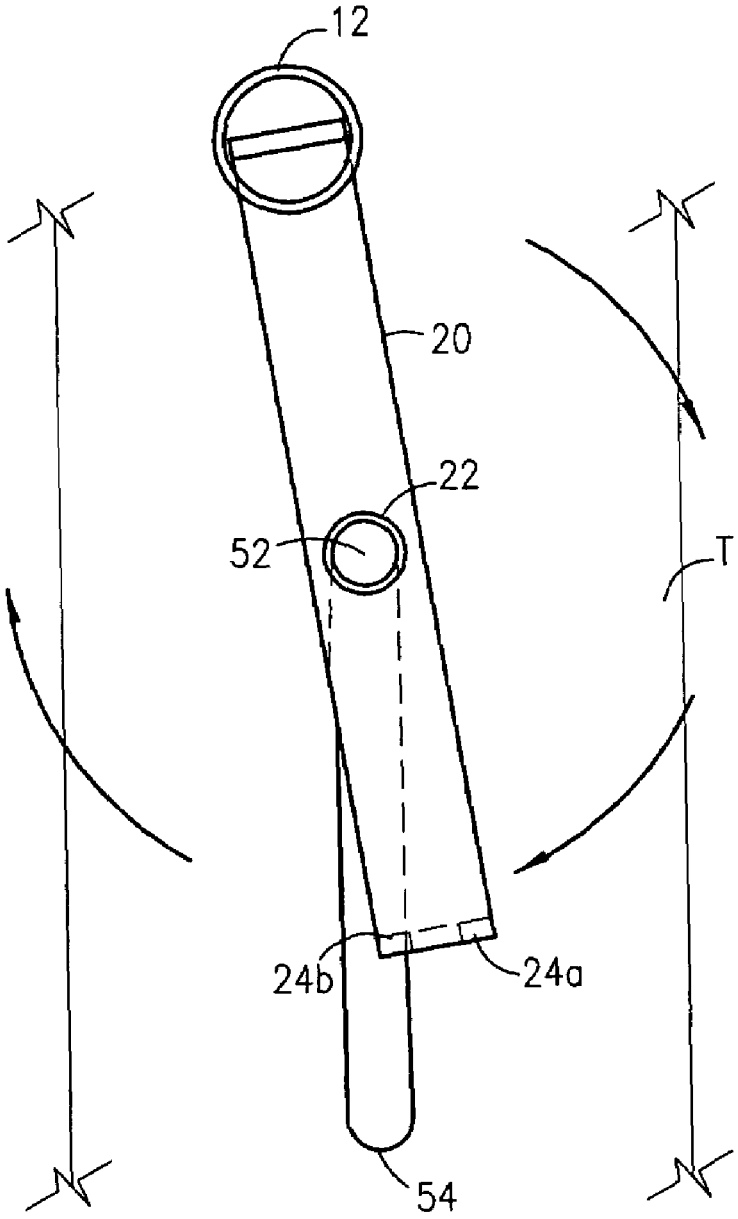
FIG. 3 is a front view of the tool engaging a step for installation of the step into a tree.

Referring specifically to FIG. 3, if a step 50 is selected for installation, the tool 10 must be rotated in a clockwise (right-handed) manner about the step 50 (when viewed from the user's perspective). The step portion 52 is inserted through the aperture 22. Approximately simultaneously, the tool 10 is positioned so that the aperture abuts the junction of the step portion 52 and the member 56, and the indentation 24*b* engages the member 56. The arm 20 is temporarily impinged by friction of the aperture 22 against the step portion 52 as it bends. For purposes of clarity, indentation 24*b* may be identified as the clockwise indentation 24*b*, indicating that indentation 24*b* engages the member 56 for clockwise rotation of the step 50. With the tool 10 impinged at the aperture 22 and engaged at the clockwise indentation 24*b*, the user may rotate the tool 10 via handle 12 in a clockwise manner until the threads of the tail portion 54 are firmly threaded into the trunk of the tree.

Figure 4:
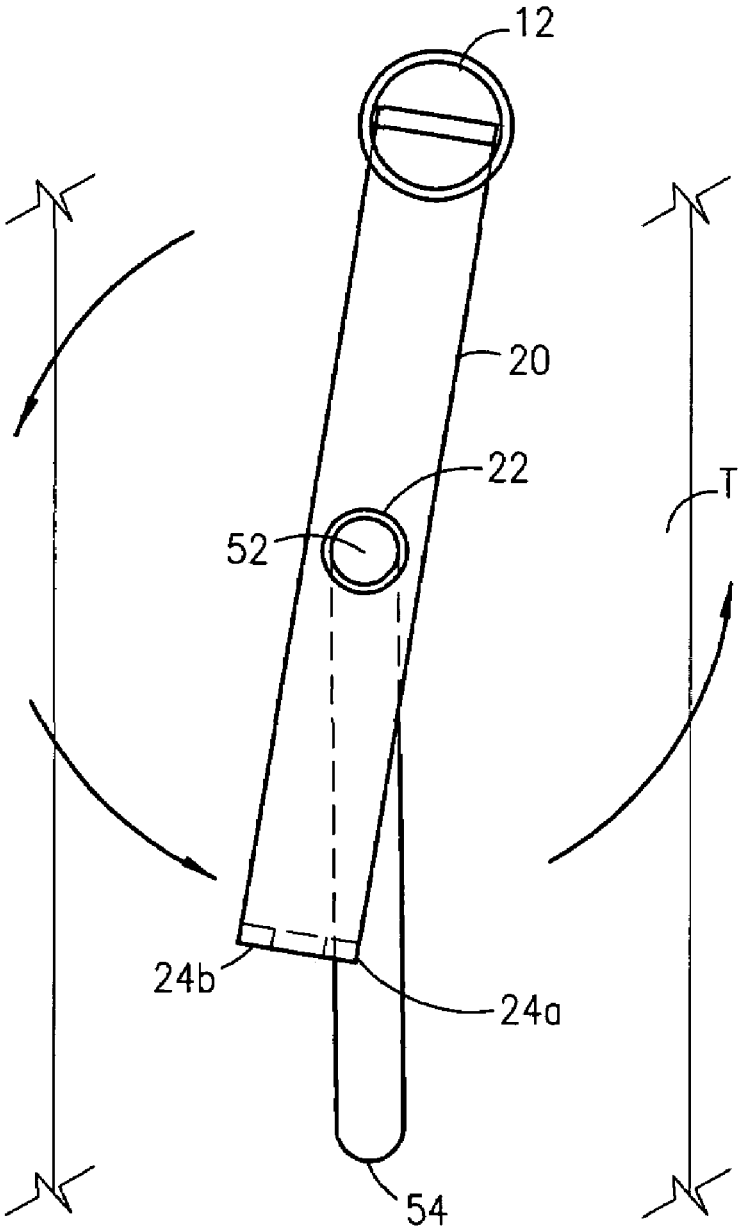
FIG. 4 is a front view of the tool engaging a step for removal of the step from the tree.

Referring specifically to FIG. 4, if a step 50 is selected for removal, the tool 10 must be rotated in a counterclockwise (left-handed) manner about the step 50 (when viewed from the user's perspective). The step portion 52 is inserted through the aperture 22. Approximately simultaneously, the tool 10 is positioned so that the aperture abuts the junction of the step portion 52 and the member 56, and the indentation 24*a* engages the member 56. The arm 20 is temporarily impinged by friction of the aperture 22 against the step portion 52 as it bends. For purposes of clarity, indentation 24*a* may be identified as the counterclockwise indentation 24*b*, indicating that indentation 24*a* engages the member 56 for counterclockwise rotation of the step 50. With the tool 10 impinged at the aperture 22 and engaged at the counterclockwise indentation 24*b*, the user may rotate the tool 10 via handle 12 in a counterclockwise manner until the threads of the tail portion 54 are released from the trunk of the tree.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the claims appended hereto and their equivalents. Therefore, the scope of the invention is to be limited only by the following claims.

What is claimed is:

1. A tool for installing and removing a tree step, said tool comprising:

a handle affixed at an end;

a tongue at an opposite end, said tongue having a pair of indentations accommodating an intermediate member of the tree step; and a linearly elongated arm disposed intermediately between the ends, said arm having an aperture accommodating a step portion of the tree step;

wherein one of said indentations impinges against the intermediate member and allows said tool to rotate about the coupling of said aperture and the step portion as said handle is used to rotatably thread the tree step into a tree.

2. The tool of claim 1 further comprises a tether (26) temporarily holding or storing said tool.

3. The tool of claim 1, wherein said handle has a pad or cushion.

4. The tool of claim 1, wherein said handle has a contoured surface for enhancing ergonomic placement of a hand.

5. The tool of claim 1, wherein said indentations comprise:

a clockwise indentation for engaging the intermediate member and permitting clockwise rotation of said tool for installing the tree step; and a counterclockwise indentation for engaging the intermediate member and permitting counterclockwise rotation of said tool for removing the tree step.

* * * * *